US006334490B1

(12) United States Patent
Dille

(10) Patent No.: US 6,334,490 B1
(45) Date of Patent: Jan. 1, 2002

(54) PASSENGER AND CARGO AREA SAFETY SYSTEM FOR VEHICLES

(76) Inventor: Tommy A. Dille, P.O. Box 18644, Cleveland Heights, OH (US) 44118

( * ) Notice: Subject to any disclaimer, the term of this patent is extended or adjusted under 35 U.S.C. 154(b) by 0 days.

(21) Appl. No.: 09/588,624

(22) Filed: Jun. 7, 2000

(51) Int. Cl.[7] ..... A62C 3/07

(52) U.S. Cl. ..... 169/62; 169/14; 169/16; 239/302; 239/311; 239/419; 239/565; 280/736; 252/3

(58) Field of Search ..... 169/9, 14, 16, 169/15, 26, 54, 60, 61, 62, 70, DIG. 2, 56; 239/67, 69, 302, 304, 311, 307, 337, 419, 548, 556, 565, 504; 280/736, 742, 748, 805; 252/3

(56) References Cited

U.S. PATENT DOCUMENTS

| | | | | | |
|---|---|---|---|---|---|
| 2,338,440 | A | * | 1/1944 | Kochmann | 169/62 |
| 3,309,109 | A | | 3/1967 | Baughman | |
| 3,465,827 | A | * | 9/1969 | Levy et al. | 169/61 |
| 3,503,600 | A | | 3/1970 | Rich | |
| 3,588,142 | A | * | 6/1971 | Gorman | 280/736 |
| 3,822,076 | A | | 7/1974 | Mercier et al. | |
| 3,876,011 | A | * | 4/1975 | Poitras | 169/26 X |
| 4,177,863 | A | * | 12/1979 | Simon | 169/62 |
| 4,383,579 | A | | 5/1983 | Monk | |
| 5,244,229 | A | | 9/1993 | Breed et al. | |
| 5,334,646 | A | | 8/1994 | Chen | |
| 5,732,785 | A | | 3/1998 | Ran et al. | |
| 5,794,975 | A | | 8/1998 | Nohr et al. | |
| 5,908,074 | A | * | 6/1999 | Potts | 169/62 X |
| 5,984,016 | A | * | 11/1999 | Samuelsson | 169/62 |

FOREIGN PATENT DOCUMENTS

| | | |
|---|---|---|
| DE | 4233155 A1 | 4/1994 |
| GB | 1661015 A1 | 7/1991 |

* cited by examiner

*Primary Examiner*—Steven J. Ganey
(74) *Attorney, Agent, or Firm*—Richard C. Litman

(57) ABSTRACT

A passenger and cargo area fire safety system for a vehicle actuated by a collision comprising a series of impact sensors and a series of fire extinguishing gel injector nozzles placed around the perimeter of the vehicle including the passenger compartment and the trunk compartment. The gel is stored as a dry, powdered concentrate which when expelled and contacting air becomes a semi-solid gel protecting the passengers from injury and the cargo from damage.

5 Claims, 2 Drawing Sheets

PASSENGER AND CARGO AREA SAFETY SYSTEM FOR VEHICLES

BACKGROUND OF THE INVENTION

1. Field of the Invention

The present invention relates generally to shock actuated safety systems for vehicles. More specifically, the present invention is a passenger and cargo safety system comprising a system of impact sensors and protective foam gel dispensers.

2. Description of the Related Art

The related art of interest describes various shock actuated fire extinguishing or shock absorbing systems, but none discloses the present invention. There is a need for an effective system for protection of the occupants and cargo in a vehicle involved in a collision which would form a shock absorbing layer. The related art will be discussed in the order of perceived relevance to the present invention.

U.S. Pat. No. 4,383,579 issued on May 17, 1983, to Guerdon M. Monk describes a shock actuated fire prevention system for automobiles comprising a portable foam generator system employed in a plurality of separate trip zones provided in the passenger compartment, the engine compartment, and the fuel tank compartment, inter alia. The system is distinguishable for its requirement for preventing fires in vehicles resulting from a collision.

U.S. Pat. No. 5,244,229 issued on Sep. 14, 1993, to Allen Breed et al. describes a mechanical crash sensor for a passenger restraint system. The sensor triggers primers for inflating air bags. The crash sensor is distinguishable for its connection to an airbag.

German Patent Application No. 4,233,155 A1 published on Apr. 14, 1994, for Franz Muller describes a vehicle safety device for passenger and load impact protection comprising sensors on the periphery of a vehicle body working with a trigger mechanism mounted in the engine compartment to give a maximum reaction time of 0.03 second. The trigger mechanism must move over a distance of 30 cm. relative to the mass being damped to activate the airbags distributed in the doors and seats. The device is distinguishable for employing airbags.

Soviet Union Patent Application No. 1,661,015 A1 published on Jul. 7, 1991, for Yu V. Filippov describes a collision sensor in a passive vehicle safety device which has an end face of an inertial mass facing a switch made with a surface layer of low melting material, i.e., solder, to complete an electrical circuit on impact to ignite a single gas source. The device is distinguishable for its singular application.

U.S. Pat. No. 5,334,646 issued on Aug. 2, 1994, to John Y. Chen describes thermoplastic elastomer gelatinous compositions which are transparent with excellent shape retention and useful as a shock absorber.

The following patents disclose various shock absorbing structures for vehicles.

U.S. Pat. No. 3,822,076 issued on Jul. 2, 1974, to Jacques Mercier et al. describes a fluid shock absorbing buffer.

U.S. Pat. No. 3,503,600 issued on Mar. 31, 1970, to John W. Rich describes liquid shock absorbing buffers.

U.S. Pat. No. 5,732,785 issued on Mar. 31, 1998, to Bin Ran et al. describes a proactive exterior airbag system for an automobile.

U.S. Pat. No. 5,794,975 issued on Aug. 18, 1998, to Matthias Nohr et al. describes a motor vehicle impact passenger protection system comprising a device with energy absorbing pins emerging when a collision occurs.

U.S. Pat. No. 3,309,109 issued on Mar. 14, 1967, to Richard A. Baughman describes a protective device positioned on the roof of a vehicle providing inflated rubber or plastic balloons into the passenger compartment during a collision.

None of the above inventions and patents, taken either singularly or in combination, is seen to describe the instant invention as claimed. Thus, a passenger and cargo area safety system for vehicles involved in a collision solving the aforementioned problems is desired.

SUMMARY OF THE INVENTION

Accordingly, it is a principal object of the invention to provide a passenger and cargo safety system for vehicles.

It is another object of the invention to provide a passenger and cargo safety system for vehicles activated by a collision.

It is a further object of the invention to provide a perimeter system of electrically operated impact sensors.

Still another object of the invention is to provide a perimeter of a protective coating gel which solidifies upon exposure to air to protect the occupants and cargo.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
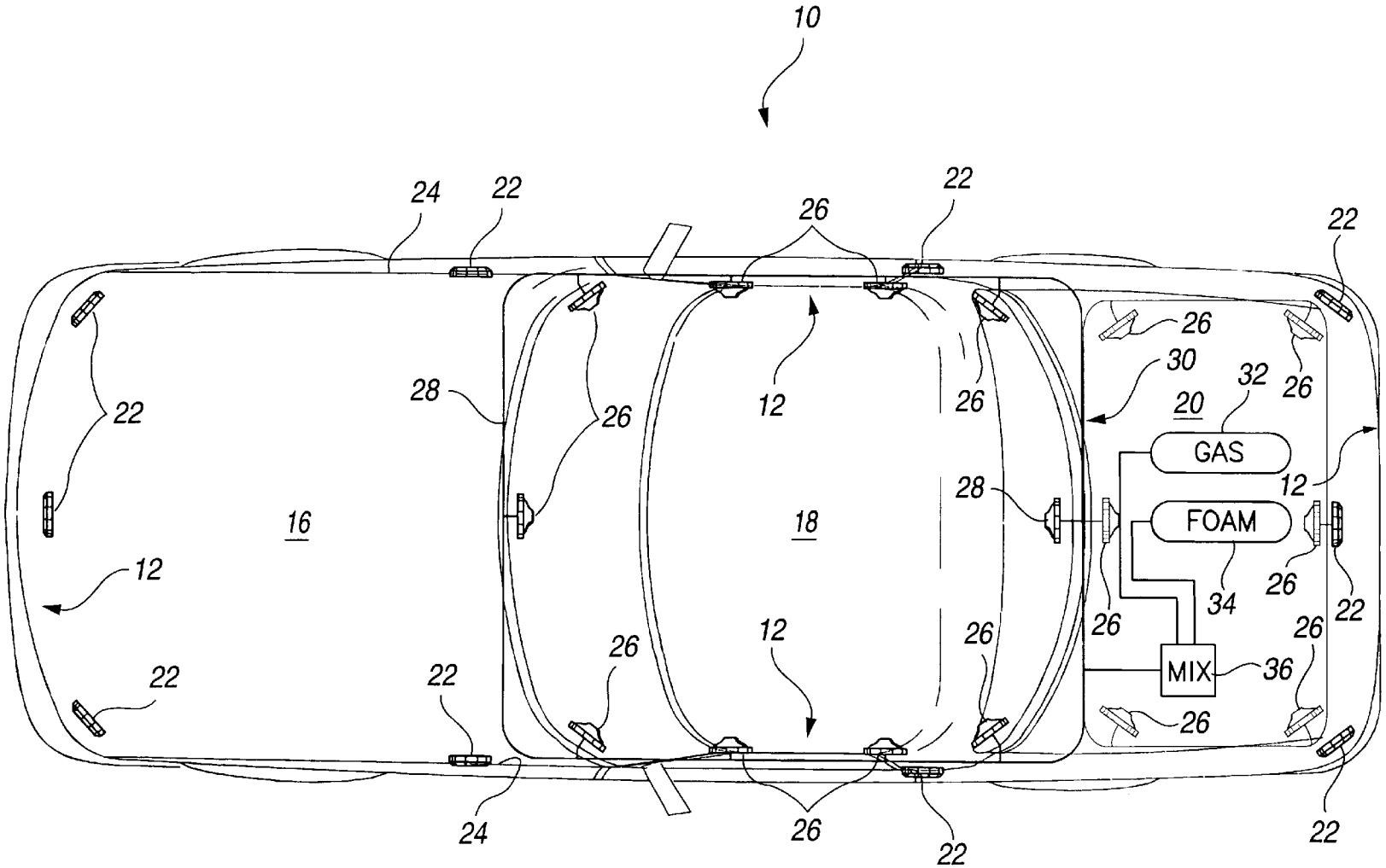
FIG. 1 is a schematic environmental plan view of a vehicle installed with the collision safety system according to the present invention.

The present invention is directed to a passenger and cargo area fire extinguishing system actuated by a predetermined degree of shock involved in a collision. In FIG. 1, the safety system 10 is shown installed in perimeter regions 12 of the vehicle 14 which include an engine compartment 16, a passenger compartment 18 and a cargo (or trunk) compartment 20.

A plurality of conventional impact sensors 22 in an electrical circuit 24 and conventional foam injector nozzles 26 in a conduit line 28 are positioned along the perimeter regions 12 located in the roofs of the passenger compartment 18 and the cargo compartment 20.

A chemical conduit circuit 30 contains a pressurized gas propellent containing tank 32, a foam gel containing tank 34 and a mixing tank 36 located below the floor in the cargo compartment 20. As illustrated in FIG. 1, when a predetermined shock will be detected by at least one of the impact sensors 22 and its signals communicated to the pressurized gas containing tank 32 to release its gaseous propellant, e.g., innocuous gas such as air or an inert gas, and to the foam gel containing tank 34 to release its foam gel to proceed to a mixing tank 36 and into the conduit line containing the injector nozzles 26 for injection of the foam gel into the passenger and cargo compartments, 18, 20, respectively, to provide a protective and resilient foam gel coating in the vicinity of the injector nozzles 26.

Figure 2:
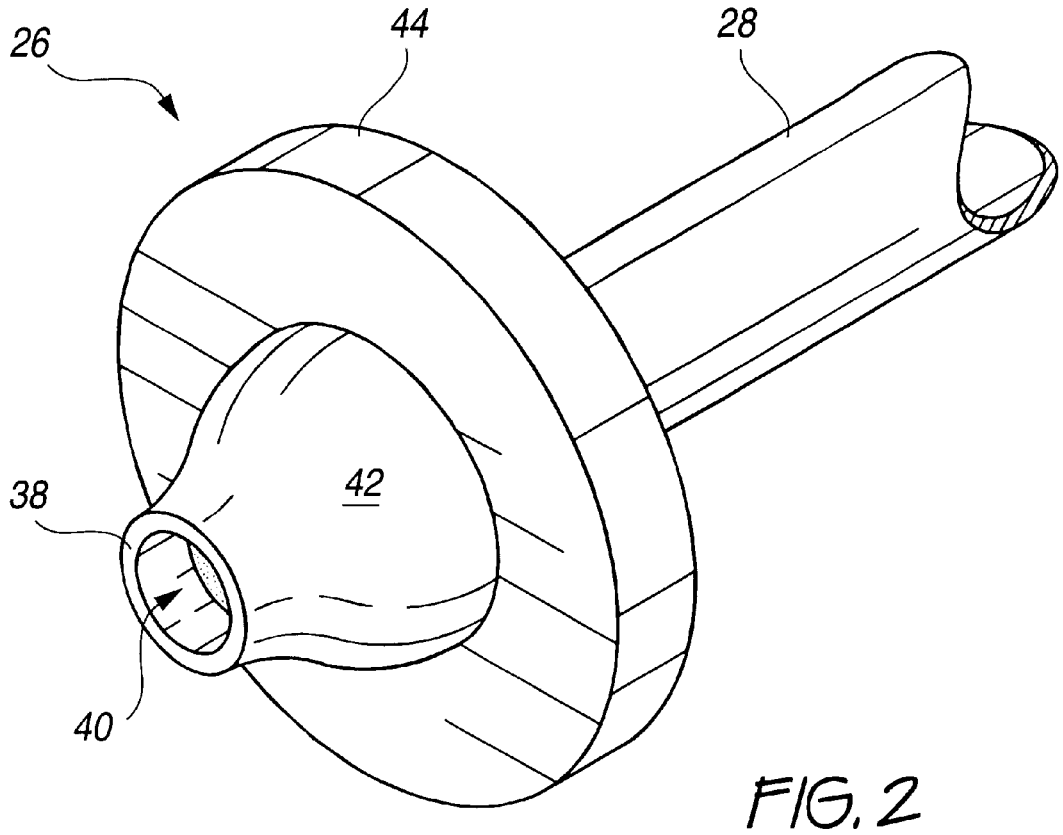
FIG. 2 is a perspective view of a gel sprayer unit.

In FIG. 2, a representative foam injector nozzle 26 is depicted having a narrow circular nozzle portion 38 containing a plurality of apertures 40 and a wider circular base portion 42 based on a flat circular flange 44. A fluid conduit 28 connects the nozzle 26 to the chemical conduit circuit shown in FIG. 1.

Figure 3:
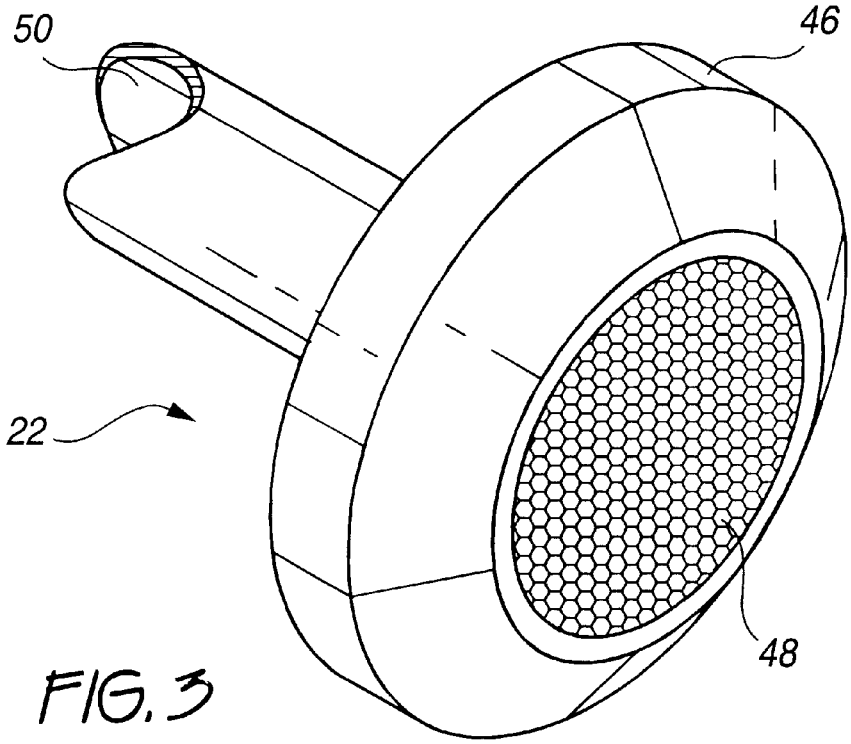
FIG. 3 is a perspective view of a sensor unit.

In FIG. 3, a representative impact sensor device 22 is shown having a circular head 46 containing a conventional pressure sensitive portion 48 which is powered by the vehicle's electrical system to convey the electrical signals via the wire 50 to the electrical circuit 24 of the safety system 10.

Thus, any portion of the vehicle 14 protected by the safety system 10 will immediately protect the occupants and cargo when an impact or collision is detected by the impact sensors 22.

The chemical composition of the foam gel can be conventional and similar to the compositions of Chen discussed above. It is contemplated that the foam gel can initially be in the form of powder reacting with a reactive gas but innocuous propellent composition.

It is to be understood that the present invention is not limited to the embodiment described above, but encompasses any and all embodiments within the scope of the following claims.

I claim:

1. A vehicle and collision safety system comprising:

a vehicle including perimeter regions for a passenger compartment and a cargo compartment;

a collision safety system comprising a plurality of impact sensors in an electrical circuit and injector nozzles in a conduit line positioned along the perimeter regions; and a chemical producing conduit circuit in communication with said electrical circuit and communicating with said conduit line, said chemical producing conduit circuit containing a pressurized gaseous propellent containing tank, a foam gel containing tank and a mixing tank, wherein the gaseous propellent and the foam gel are combined in the mixing tank;

whereby a predetermined shock detected by at least one of the plurality of impact sensors causes the pressurized gas containing tank to release the gaseous propellant and the foam gel containing tank to release the foam gel to proceed to the mixing tank and into the conduit line containing the injector nozzles for injection into the passenger and cargo compartments to provide a protective and resilient foam gel coating in the vicinity of the injector nozzles.

2. The vehicle and collision safety system according to claim 1, wherein the plurality of impact sensors and injector nozzles are positioned in a roof of the passenger and cargo compartments.

3. The vehicle and collision safety system according to claim 1, wherein the chemical producing conduit circuit is positioned below the floor of the cargo compartment.

4. The vehicle and collision safety system according to claim 1, wherein the injector nozzles are individually configured as a narrow circular nozzle opening containing a plurality of apertures with a wider circular base and based on a flat circular flange.

5. The vehicle and collision safety system according to claim 1, wherein the plurality of impact sensors are individually configured as pressure sensitive circular bodies.

* * * * *